US010458744B2

(12) United States Patent
Iwasawa

(10) Patent No.: US 10,458,744 B2
(45) Date of Patent: Oct. 29, 2019

(54) SHOCK-ABSORPTION DEVICE OF PISTON MECHANISM IN SIMULATION GUN

(71) Applicant: TOKYO MARUI CO, LTD., Tokyo (JP)

(72) Inventor: Iwao Iwasawa, Tokyo (JP)

(73) Assignee: TOKYO MARUI CO, LTD., Tokyo (JP)

( * ) Notice: Subject to any disclaimer, the term of this patent is extended or adjusted under 35 U.S.C. 154(b) by 79 days.

(21) Appl. No.: 15/572,875

(22) PCT Filed: May 12, 2015

(86) PCT No.: PCT/JP2015/063662

§ 371 (c)(1),
(2) Date: Nov. 9, 2017

(87) PCT Pub. No.: WO2016/181506

PCT Pub. Date: Nov. 17, 2016

(65) Prior Publication Data

US 2018/0120049 A1 May 3, 2018

(51) Int. Cl.

| | |
|---|---|
| ***F41B 11/00*** | (2013.01) |
| ***F41B 11/643*** | (2013.01) |
| ***F41B 11/721*** | (2013.01) |
| ***F41A 33/06*** | (2006.01) |
| *F41B 11/56* | (2013.01) |
| *F41B 11/62* | (2013.01) |

(52) U.S. Cl.
CPC ..... *F41B 11/643* (2013.01); *F41A 33/06* (2013.01); *F41B 11/721* (2013.01); *F41B 11/56* (2013.01); *F41B 11/62* (2013.01)

(58) Field of Classification Search
CPC ..... F41A 33/06; F41B 11/643
See application file for complete search history.

(56) References Cited

U.S. PATENT DOCUMENTS

| | | | | |
|---|---|---|---|---|
| 2008/0155875 | A1* | 7/2008 | Iwasawa | F41B 11/644 42/54 |
| 2011/0041825 | A1* | 2/2011 | Hu | F41A 33/06 124/71 |
| 2012/0138038 | A1* | 6/2012 | Lee | F41B 11/644 124/80 |
| 2018/0058800 | A1* | 3/2018 | Sandgren | F41B 11/56 |

FOREIGN PATENT DOCUMENTS

| | | | | |
|---|---|---|---|---|
| JP | S62288499 | | 12/1987 | |
| JP | H07225097 | | 8/1995 | |
| JP | 2007051851 | A * | 3/2007 | F41A 33/06 |
| WO | WO-02079709 | A2 * | 10/2002 | F41B 11/51 |
| WO | 2007122719 | | 11/2007 | |

OTHER PUBLICATIONS

International Search Report dated Aug. 11, 2015.

* cited by examiner

*Primary Examiner* — Gabriel J. Klein
(74) *Attorney, Agent, or Firm* — Jacobson Holman, PLLC.

(57) ABSTRACT

A simulation gun in which an air current is ejected by an operation of a piston mechanism portion to fire a bullet, a piston stop which is movable relative to a piston mechanism portion is provided, the piston stop is attached to one constituent member of the piston mechanism portion to absorb an impact force accompanying the operation of the piston mechanism portion, and shock-absorption means is provided between the piston stop and the other constituent member of the piston mechanism portion.

3 Claims, 7 Drawing Sheets

SHOCK-ABSORPTION DEVICE OF PISTON MECHANISM IN SIMULATION GUN

BACKGROUND OF THE INVENTION

The present invention relates to a shock-absorption device of a piston mechanism in a simulation gun in which an air current is ejected by an operation of a piston mechanism portion to fire a bullet.

BACKGROUND ART

For guns which imitate real guns and guns which do not have the ability to kill, in the present invention, they are collectively referred to as simulation guns. There are various kinds of simulation guns, and the simulation guns are mainly targeted for hobbies. However, currently, the simulation guns are widely used as substitutes for real guns in exercises or the like in various organizations, institutions, or the like. In the case of the simulation gun, for example, there is a model gun or the like not aiming to fire a bullet, as well as a gas gun which uses a high-pressure gas, an air gun which uses compressed air, an electric gun which obtains compressed air with a piston, or the like to fire a bullet, and types and product development of the simulation gun are extensive.

In the simulation gun, a piston mechanism is often used to eject an air current (flow of gas) to a bullet. The gas gun, the air gun, and the electric gun also include a configuration corresponding to the piston mechanism, and in the air gun or the like, any one of a piston and a cylinder rapidly moves to compress an air current, and in the gas gun, a movement in which a movement direction of the piston mechanism is changed suddenly is generated by bullet firing and blowback immediately after the bullet firing. Accordingly, a moving member abuts on other members to cause impact, which may cause problems such as durability.

Meanwhile, in the related art, countermeasures are taken to change a material of a colliding member. However, in general, the material cannot be easily obtained, which causes problems such as a material price being expensive and requiring ingenuity in machining and mounting. For example, examining the prior art, Japanese Unexamined Patent Application Publication No. H7-225097 is an invention relating to an airsoft gun, and the invention discloses a braking mechanism in which a compression pressure at an end of a compression process of a piston is increased sharply than a compression pressure in a normal compression process. However, in order to use the compression pressure in the braking mechanism, it is necessary to newly form a bypass passage in a piston mechanism and to incorporate a flow control valve, the structure and the control are complicated, and thus, Japanese Unexamined Patent Application Publication No. H7-225097 does not have versatility.

PATENT LITERATURE

Japanese Unexamined Patent Application Publication No. H7-225097

BRIEF SUMMARY OF THE INVENTION

Technical Problem

The present invention is made in consideration of the above-described problems, and an object thereof is to attenuate impact applied to a piston mechanism portion and improve durability in a simulation gun in which an air current is ejected by an operation of the piston mechanism portion to fire a bullet. In addition, another object of the present invention is to provide a shock-absorption device of a piston mechanism which can be embodied without largely changing a mechanism and a structure of a target simulation gun.

Solution to Problem

In order to achieve the objects, according to an aspect of the present invention, there is provided a shock-absorption device of a piston mechanism in a simulation gun in which an air current is ejected by an operation of a piston mechanism portion to fire a bullet, in which a piston stop which is movable relative to the piston mechanism portion is provided in the piston mechanism portion, the piston stop is attached to one constituent member of the piston mechanism portion to absorb an impact force accompanying the operation of the piston mechanism portion, and shock-absorption means is provided, between the piston stop and the other constituent member of the piston mechanism portion.

The simulation gun which is the object of the present invention is a simulation gun having the piston mechanism portion. In a general piston, the piston is combined with a cylinder and gas is compressed inside the cylinder by the movement of piston. The present invention is not limited to the piston-cylinder mechanism with the compression of the gas. That is, any mechanism having a piston performing a reciprocating motion and a portion regarded as a cylinder providing a passage through which the piston moves is also included in the piston mechanism portion. In addition, the gas handled in the present invention is mainly gas for a gas gun. However, the gas is also applied to a piston mechanism using air as a working gas.

In the shock-absorption device of the present invention, the piston stop which can move relative to the piston mechanism portion is provided in the piston mechanism. In other words, the piston stop uses the piston mechanism as a rail and can move along the piston mechanism.

In addition, in order to absorb an impact force accompanying the operation of the piston mechanism portion, the piston stop is attached to one constituent, member of the piston mechanism portion and the shock-absorption means is provided between the one constituent member and the other constituent member. By the shock-absorption means, kinetic energy of the moving member of the piston mechanism portion can be reduced and thus, the impact can be absorbed.

In the shock-absorption device of the present invention, preferably, the simulation gun is a gas gun which ejects gas to the bullet by the piston mechanism portion and moves a piston mechanism and a bolt backward by a differential pressure valve mechanism built in the piston mechanism, and a mass of the piston mechanism portion which moves backward is weighed to a mass of the bolt as the impact force. In order to obtain a recoil shock, preferably, the bolt has a relatively large mass. The piston mechanism portion has a portion of the required mass, and thus, advantages such as reductions in a size and weight of the bolt can be obtained.

In addition, a piston of the piston mechanism portion is movable inside a cylinder, the cylinder includes a guide portion in a front-rear direction outside the cylinder, the piston stop is provided to be movable in the front-rear direction within a predetermined, range by engagement between the piston stop and the guide portion, and a coil spring which is the shock-absorption means is provided between a spring holder provided in the cylinder and the piston stop.

Advantageous Effects of Invention

As described above, in the present invention, it is possible to attenuate impact applied to the piston mechanism portion by the shock-absorption means and improve durability in the simulation gun in which the air current is ejected by an operation of the piston mechanism portion to fire a bullet. In addition, according to the present invention, it is possible to provide the shock-absorption device of the piston mechanism which can be embodied by providing the shock-absorption means between the piston mechanism portion and the piston stop without largely changing a mechanism and a structure of a target simulation gun.

BRIEF DESCRIPTION OF DRAWINGS

FIG. 3 consists of FIGS. 3A, 3B, and 3C and shows an operation state of the shock-absorption device.

FIG. 4 consists of FIGS. 4A and 4E and shows an operation of the gas gun.

FIG. 5 consists of FIGS. 5A and 5B and shows the operation of the gas gun.

FIG. 6 consists of FIGS. 6A and 6B and shows the operation of the gas gun.

FIG. 7 consists of FIGS. 7A and 7B and shows the operation of the gas gun.

DETAILED DESCRIPTION OF THE INVENTION

Hereinafter, the present invention will be described in detail with reference to an embodiment shown. A shock-absorption device of a piston mechanism in a simulation gun of the present invention is applied to all simulation guns and is not limited to a gas gun. However, for convenience, first, an outline of the gas gun will, be described.

Figure 1:
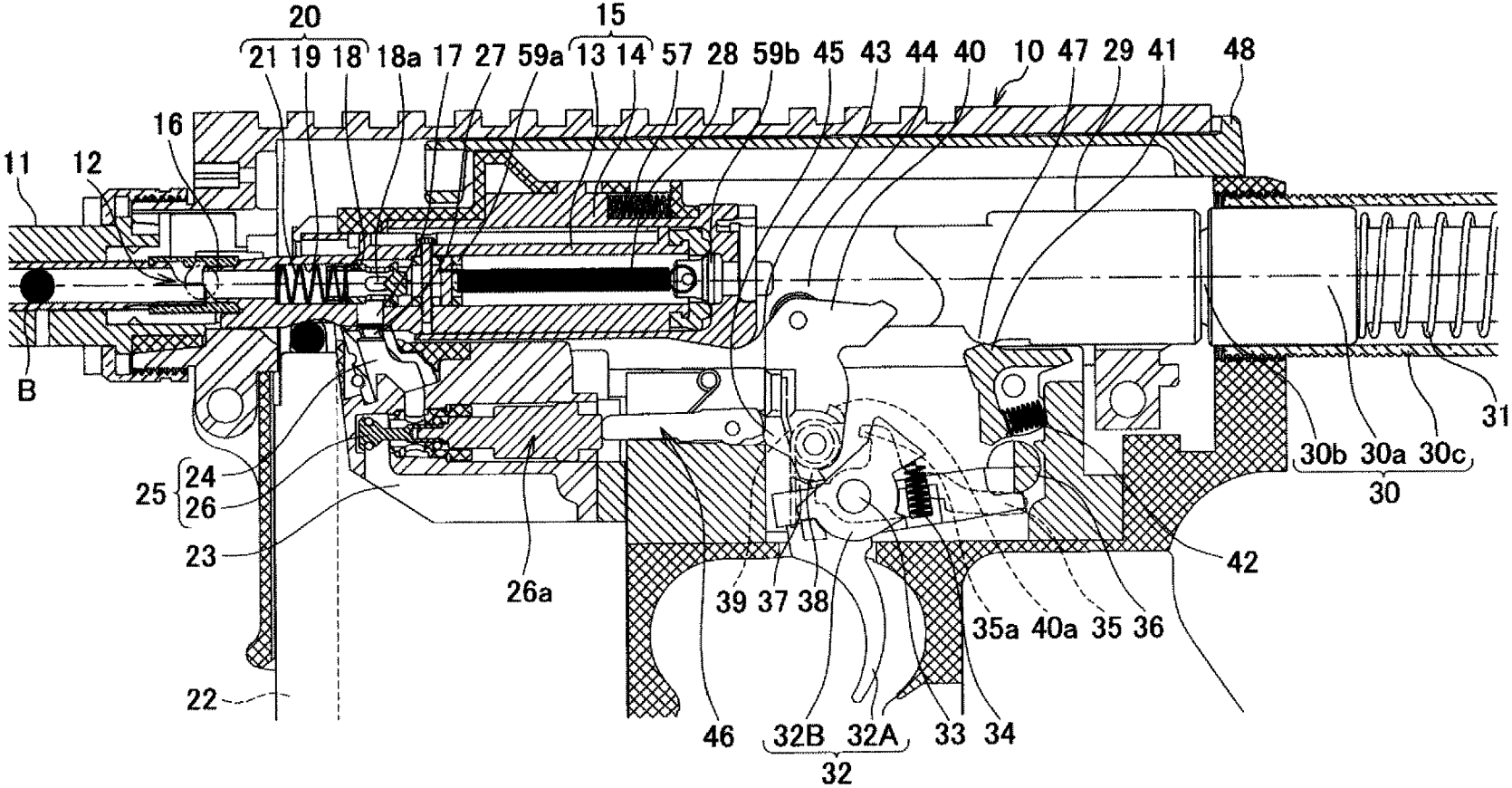
FIG. 1 is a sectional explanatory view showing an example of a gas gun to which a shock-absorption device of a piston mechanism in a simulation gun according to present invention is applied.

A gun exemplified as a simulation gun G in FIG. 1 is a blowback type gas gun. In the shown simulation gun G, a firing set portion 10 is provided in a center portion of a gun body, a barrel portion 11 is provided in front of the gun body 10, a magazine portion 22 is provided below the gun body, and a movable body portion 30 for a blowback bolt 29 is provided behind the gun body.

A bullet portion 12 is provided at the rear portion of the barrel portion 11, gas is ejected to a bullet B loaded on the bullet portion 12 via a differential pressure valve mechanism 20 provided in the firing set portion 10, and as a result, the bullet 3 is fired. A piston mechanism portion 15 is provided in the firing set portion 10, and the piston mechanism portion 15 includes a piston 13 which is movably disposed in a barrel axial direction and a cylinder 14 which functions as a movement space, of the piston 13. The piston 13 is formed in a hollow cylindrical shape which includes a nozzle portion 16 ejecting the gas to the bullet B on a tip of the piston 13 and an opening, which is open to a closed end of the cylinder 14, on a rear end of the piston 13.

In the piston 13, a gas inlet 17 communicating with the inside and outside is open to a lower portion close to the front end, and the differential pressure valve mechanism 20 is provided in the vicinity of the gas inlet 17. The differential pressure valve mechanism 20 includes a differential pressure valve 18 which is disposed between the nozzle portion 16 positioned on the tip and the differential pressure valve mechanism 20, a valve chamber 19 in which the differential pressure valve 18 can move forward or backward, and a return spring 21 which is disposed in the valve chamber. An outer diameter of the differential pressure valve 18 is set so as to have a dimensional difference of a degree of sliding fit with respect to an inner diameter of the valve chamber 19.

Moreover, the differential pressure valve 18 is formed of a tubular valve in which a front end side thereof is open and a rear end side thereof is closed, and a gas passage hole 18*a* is provided on a peripheral surface of the differential pressure valve 18. Accordingly, the differential pressure valve 18 fires the bullet B which is moved backward by the return spring 21 and positioned at the bullet, portion 12, moves forward, by the pressure of the gas continuously flowing in the differential pressure valve 18 thereafter to close a valve, and introduces the gas flow to the cylinder 14. In this way, since an operation direction of the valve body is changed by the pressure difference, the differential pressure valve 18 is referred to as a differential pressure valve. The gas flow is introduced to the cylinder 14 and is used for a blowback operation.

The gas fills a gas tank 23 inside the magazine portion 22, and the gas is supplied from the gas tank 23 to the piston mechanism portion 15 via an on-off valve mechanism 25 according to a manipulation of a trigger-described later. The on-off valve mechanism 25 includes a gas flow path 24 from the gas tank 23 to the piston mechanism portion 15 and an on-off valve 26 which is provided to open and close the gas flow path 24, and causes the gas to flow from an outlet 27 on the gas flow path end to an inlet 17. In addition, the on-off valve 26 includes a valve shaft 26*a* exposed to the outside to be press-beaten by a hammer 40 described later which is operated by the manipulation of the trigger.

In the piston mechanism portion 15, the piston 13 is urged by a return spring 28 configured of a tension spring. A front end portion of the piston return spring 28 is a piston side member 59*a* and a rear end portion thereof is attached to a cylinder side member 59*b*. The bolt 29 has a necessary mass for experiencing a simulated recoil shock, and in this embodiment, the bolt 29 is formed in a shaft shape which is elongated in a front-rear direction. In addition, the cylinder 14 is provided to be integrated with the bolt 29, and thus, a mass of the cylinder 14 is applied to the bolt 29.

The movable body portion 30 is disposed behind the bolt 29, and the movable body portion 30 includes a casing 30*c* which is attached to the gun body and a movable shaft 30*a* which is disposed, inside the casing 30*c*. The movable shaft 30*a* is provided to be movable forward or backward inside the casing 30*c* is configured such that a rear end of the bolt 29 engages with a shaft, head 30*b*. In the drawings, a reference numeral 31 indicates a buffer spring, the buffer spring 31 urges the movable shaft 30*a* in a forward movement direction, and thus, finally, the buffer spring 31 is operated to position the piston mechanism portion 15 in a firing preparation state. In addition, the buffer spring 31 receives the bolt 29 when the bolt 29 moves backward and also functions as means for adjusting the impact at the end of the recoil shock.

In order to operate the firing set portion 10, a trigger 32 is provided. The trigger 32 is configured by combining two members 32A and 32B, the trigger member 32A is a manipulating portion, and the trigger member 32B is a manipulated member. The two members 32A and 32B are rotatable about a shaft 33 and are urged in a direction away from each other by a trigger spring 34. A reference numeral 35 indicates a disconnector, and the disconnector 35 is coaxially provided with the trigger member 32A to select a continuous shoot or a single shoot and is controlled by a selector 36.

The trigger member 32A locks the above-described hammer 40 in a cocking state. A reference numeral 37 indicates a trigger side locking portion which maintains the cocking state and a reference numeral 38 is a hammer side locking portion which maintains the locking state. A reference numeral 39 indicates a hammer spring and becomes in an accumulated pressure state at the time of cocking. Accordingly, if the trigger 32A is manipulated, an engagement between the locking portions 37 and 38 is released, and thus, the accumulated pressure of the hammer spring 39 is also released, and the hammer 40 is operated.

The hammer 40 is placed in an engagement state between a shear 41 and the hammer 40 at the time of the cocking. A spring 42 acts on the shear 41, and the shear 41 acts in a direction in which the cocking of the hammer 40 is maintained. The hammer 40 is cocked by a backward movement of the cylinder 14. Accordingly, a cam-shaped engagement protrusion 43 is provided on a lower portion of a rear end of the cylinder 14, and the engagement protrusion 44 is pivoted by the hammer 40. A reference numeral 45 indicates a press-beating portion of the hammer 40 and the press-beating portion 45 drives a valve shaft. 26*a* via a knocker 46. A reference numeral 47 indicates a bolt protrusion and the bolt, protrusion 47 rotates the shear 41 against, the shear spring 42 and causes the hammer 40 which is in the cocking state to be rotatable. A reference numeral 48 is a loading lever (charging handle), the cylinder 14 is moved, backward by manipulation of the loading lever 48 which engages with the front side of the cylinder 14, and thus, the hammer 40 can be cocked. The protrusions 44 and 47 may be simple protrusions or may be rolls.

Figure 2:
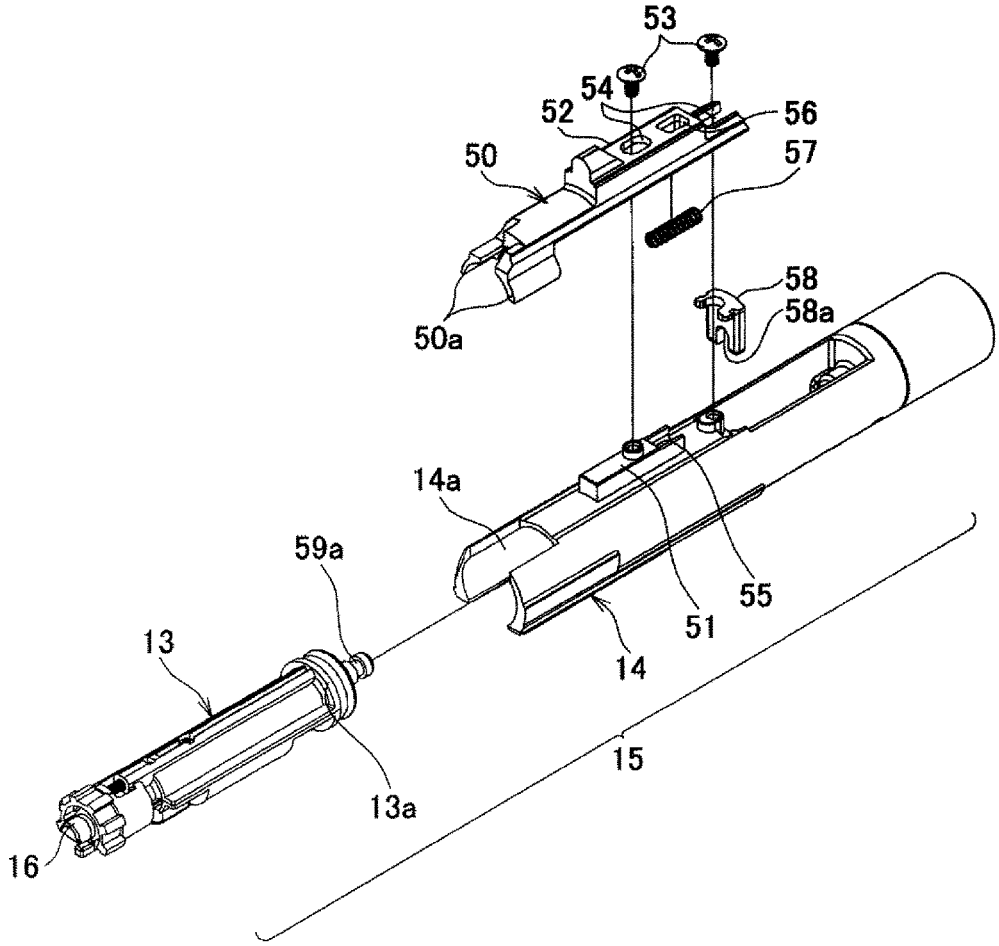
FIG. 2 is an explanatory view showing a state where the shock-absorption device is exploded.

In the shock-absorption device in the simulation gun of the present invention, a piston stop 50 which can move relative to the piston mechanism portion 15 is provided in the piston mechanism portion 15 (refer to FIG. 2). In the piston mechanism portion 15, a guide portion 51 in a front-rear direction is provided on the upper portion of the cylinder 14, and the piston stop 50 is provided to be movable in the front-rear direction within a predetermined range by an engagement, between the guide portion 51 and a guide receiving portion 52. The guide portion 51 is formed in the upper portion of the cylinder 14 in the form of an elongated protrusion in a piston moving direction, and the guide receiving portion 52 is provided at a position at which the guide receiving portion 51 engages with the guide portion 51 of the piston stop 50.

More specifically, the guide portion 51 is formed to be shorter than the guide receiving portion 52 by a required length, and is provided so as to be relatively movable in the front-rear direction by a predetermined range determined by the difference in the length (refer to FIG. 3). The piston stop 50 is attached to be movable by a predetermined range using two screws 53, and the two screws 53 are screwed into the cylinder 14 through two long holes 54, and thus, a movement within the predetermined, range can be performed. Further, in the piston stop 50, left and right wing pieces 50*a* are provided at a front end of the piston stop 50 to stabilize the movement of the piston stop 50.

The wing pieces 50*a* enter the inside of a notch 14*a* positioned at the front, end of the cylinder 14 and are positioned inside the notch 14*a*, and the wing pieces 50*a* engage with an engagement portion 13*a* positioned at the rear end of the piston 13 configuring a retaining structure of the piston 13. In this way, a coil spring which is shock-absorption means 57 is provided in a compressed state between the front spring bearing 55 provided in the cylinder 14 and the rear spring bearing 56 of the piston stop 50. A reference numeral 58 indicates a connection piece, the connection piece 58 is fixed to the cylinder side by the screws 53 positioned on the rear side, the piston 13 and a locking frame 58*a* engage with each other, and thus, the piston and the connection piece 58 are integrally connected to each other.

Figure 3A:
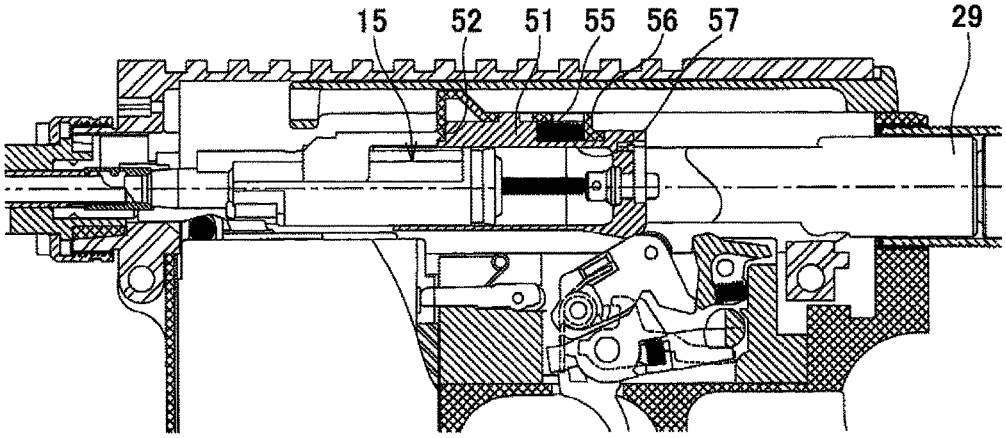
FIG. 3A is a sectional explanatory view showing a state where a bolt starts to move backward.
Figure 3B:
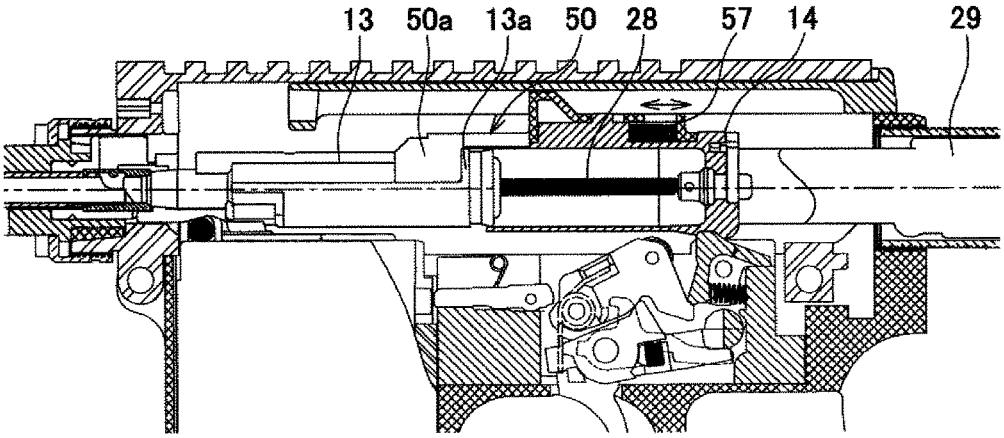
FIG. 3B is a sectional explanatory view showing a state where a piston is locked to a piston stop.

In the shock-absorption device of the piston mechanism, as a gas flow is switched backward by the operation of the differential pressure valve 13 from a state immediately after firing shown in FIG. 3A, the piston mechanism portion 15 and the bolt 29 integrated with the piston mechanism portion 15 start to move backward. If the piston mechanism portion 15 and the bolt 29 move backward to a certain extent, the piston stop 50 engages with the engagement portion 13*a* of the piston 13 at the portions of the wing pieces 50*a* and is pulled by engagement portion 13*a*, and the piston 13 starts to move backward and is further drawn to the bolt 29 by the piston return spring 28 (FIG. 3B).

Figure 3C:
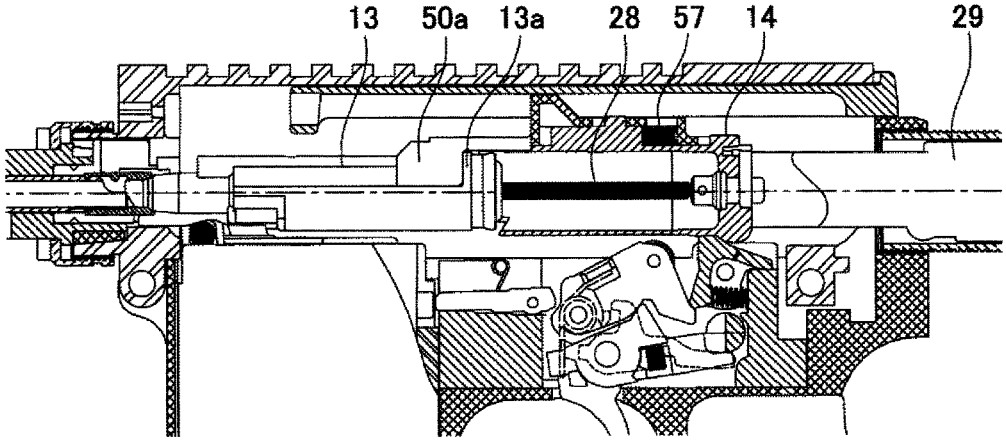
FIG. 3C is a sectional explanatory view showing a state where shock-absorption means is operated.

An acting force transmitted to the piston 13 is absorbed by the shock-absorption means 57 disposed between the front spring bearing 55 of the cylinder 14 and the rear spring bearing 56 of the piston stop 50 and is operated to compress the shock-absorption means (FIG. 3C). Accordingly, the acting force rapidly transmitted to the piston 13 is absorbed and attenuated by the shock-absorption means 57, and thus, the acting force does not become an impact force enough to damage the piston 13 and also reduces a force exerted on a related member.

Figure 4A:
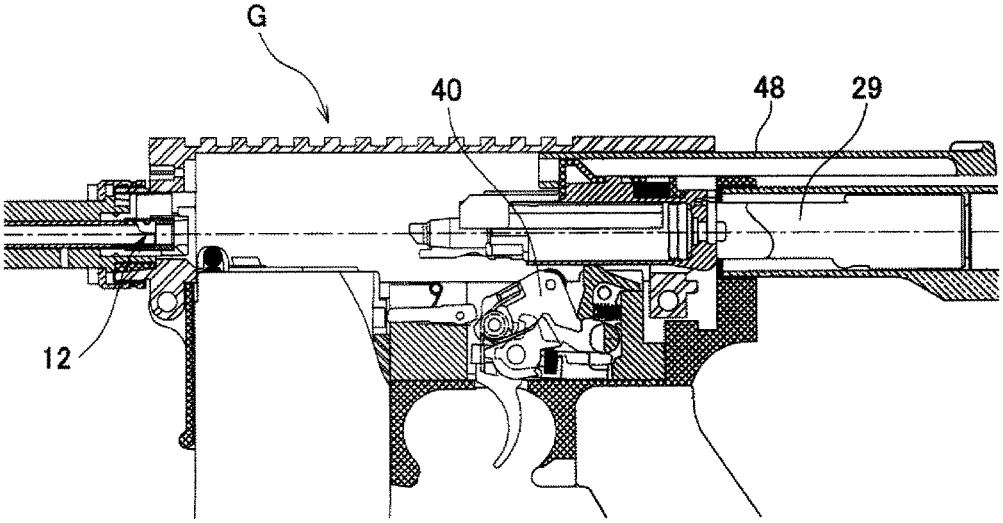
FIG. 4A is a sectional explanatory view showing a state where the bolt is manually moved backward.
Figure 4B:
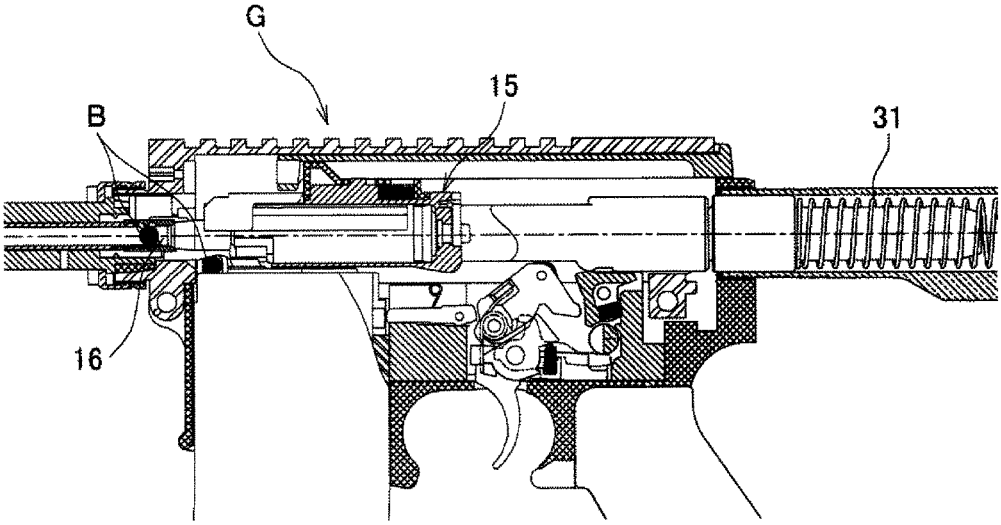
FIG. 4B is a sectional explanatory view showing a state where a bullet is manually loaded.

An overall operation of the simulation gun G in the present invention will be described as follows. The bolt 29 is moved backward by manually manipulating the loading lever 48, and the hammer 40 become in a cocking state (state of FIG. 4A). If the loading lever 48 is released, the bolt 29 is moved forward by the buffer spring 31, one bullet B is loaded into bullet portion 12 by nozzle portion 16 of the piston mechanism portion 15 which integrally moves with the bolt 29 (FIG. 4B).

Figure 5A:
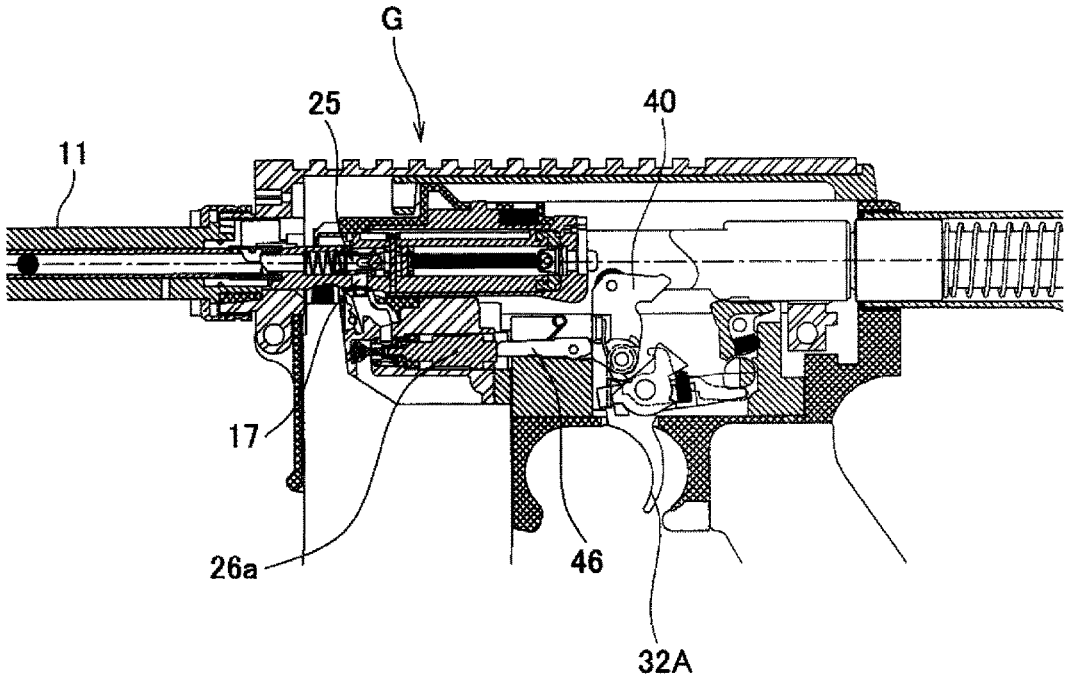
FIG. 5A is a sectional explanatory view showing a state where the bullet is fired.
Figure 5B:
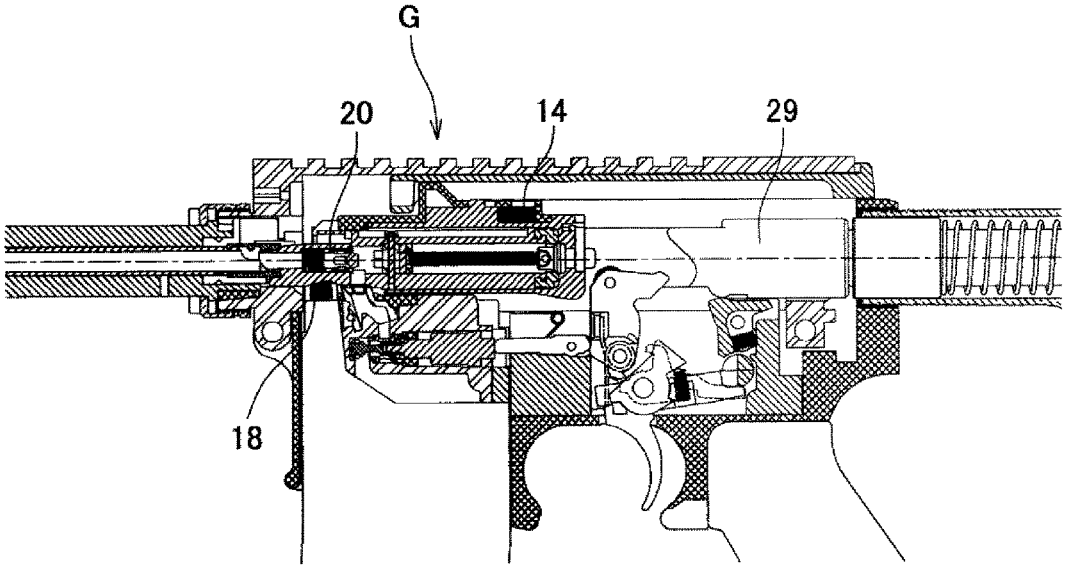
FIG. 5B is a sectional explanatory view showing a state where the bolt starts to move backward.

Subsequently, if trigger 32A is pulled and hammer 40 is operated, the valve shaft 26*a* is pushed via knocker 46, the on-off valve mechanism 25 is open, and compressed gas flows into gas inlet 17. The compressed gas flows into the differential pressure valve 18 from the gas communication port 18*a* of the differential pressure valve mechanism 20 and is ejected to bullet. B, and as a result, the bullet 3 is fired from the barrel 11 (FIG. 5A). The differential pressure valve 13 is moved forward by the pressure of the gas which continuously flows in even after the bullet is fired, the differential pressure valve mechanism 20 is closed, and the gas flow is introduced to the cylinder 14 (FIG. 5B).

Figure 6A:
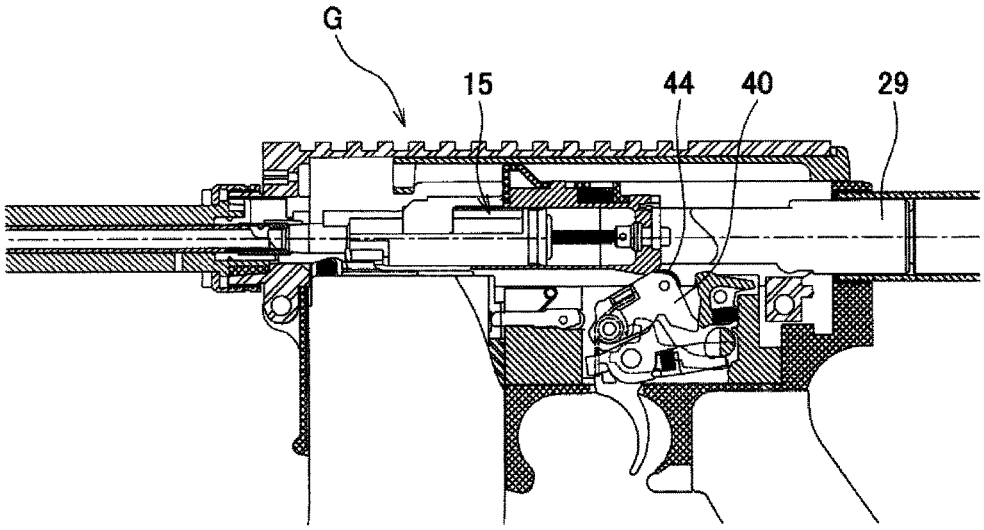
FIG. 6A is a sectional explanatory view showing a state where a hammer is cocked by the bolt.
Figure 6B:
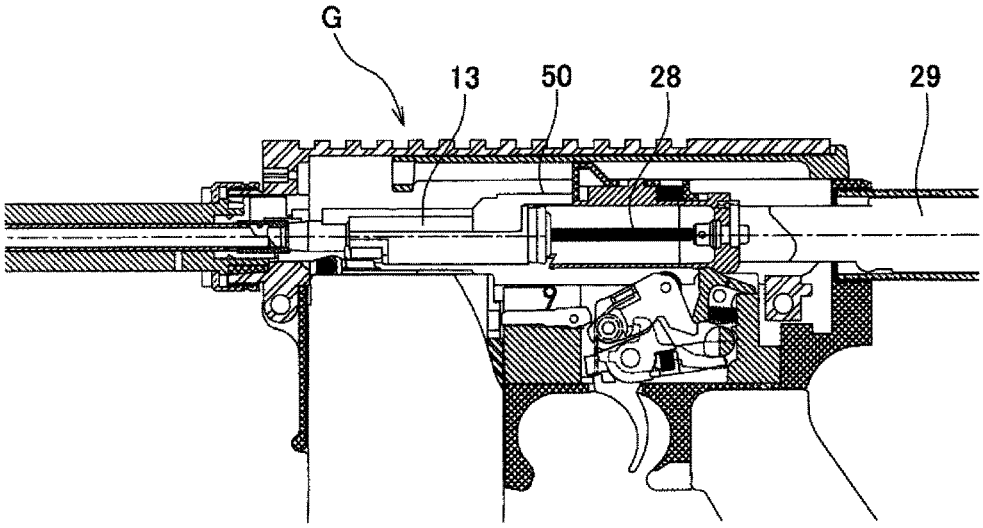
FIG. 6B is a sectional explanatory view showing a state where the piston starts to move backward.

As the gas flows into the cylinder 14, the piston mechanism portion 15 is moved backward along with the bolt 29, and in the process, the hammer 40 is cocked (FIG. 6A). If the bolt 29 is moved backward to a certain extent, the piston 13 starts to move backward along with the piston stop 50 and is drawn in a bolt direction by the piston return spring 28 (FIG. 6B).

Figure 7A:
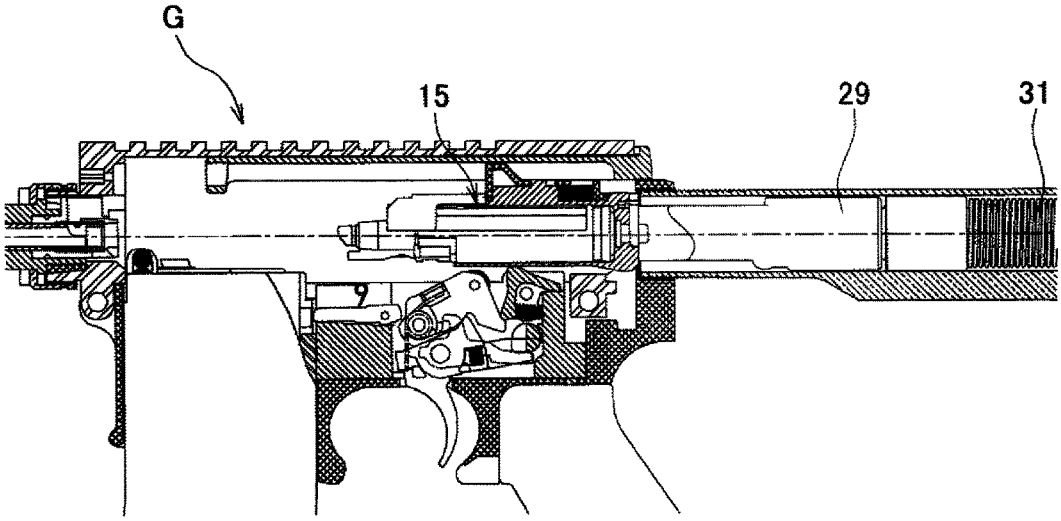
FIG. 7A is a sectional explanatory view showing a state where the bolt is positioned at a position moved backward farthest.
Figure 7B:
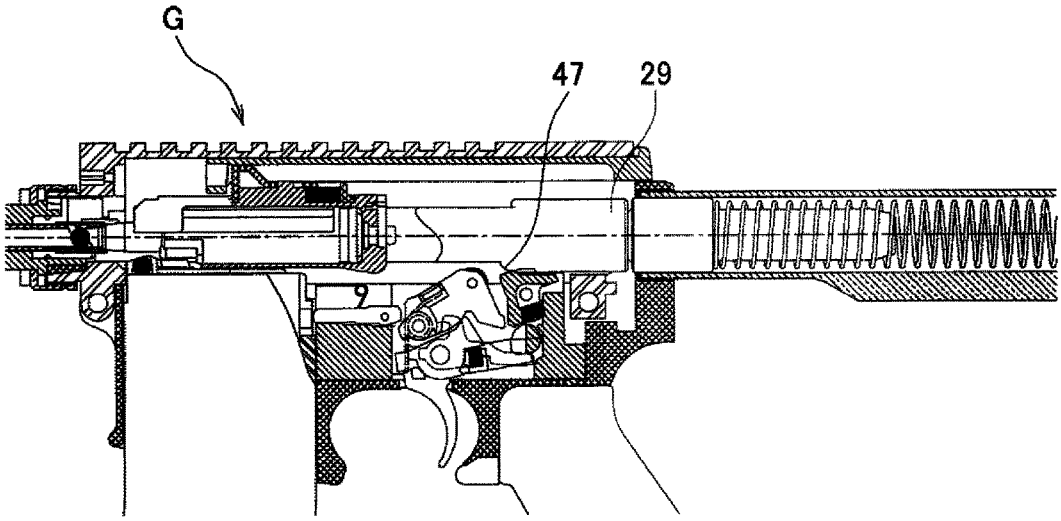
FIG. 7B is a sectional explanatory view showing a state where the bolt moves forward and the bullet is supplied to a bullet portion.

The bolt 29 stops after moving backward to a position moved backward farthest along with the piston mechanism portion 15 (FIG. 7A), and a manipulator of the simulation gun G experiences a shock accompanying the movement of the mass of the bolt 29 during this time. The buffer spring 31 accumulated by the backward movement is released, the bolt 23 is switched to move forward, and one bullet B is loaded in the bullet portion 12 by the nozzle portion 16 positioned at the tip of the piston mechanism which integrally moves with the bolt 29 (FIG. 7B). In addition, the protrusion 47 of the bolt 29 rotates the shear 41, and thus, the hammer 40 is released, the state is returned to the state of FIG. 4B, and the fire operation is repeated (fire mode). In a case of a single shoot mode, the hammer 40 engages with the disconnector 35 and the engagement portion 35*a* and 40*a* and is stopped. Since the locking is released by returning the trigger 32, the hammer 40 is locked to the trigger 32 and is held in the cocking state.

As described above, the shock-absorption device of the piston mechanism in the simulation gun of the present, invention has a countermeasure to provide the shock-absorption absorption means 57 between the piston mechanism portion 15 and the piston stop 50. Accordingly, it is possible to remarkably improve durability of the piston mechanism portion 15 in a type of a gas gun having a movement in which the movement direction of the piston 13 is changed suddenly by bullet firing and blowback immediately after the bullet firing. In particular, according to the present invention, objects thereof can be achieved by adding the movable piston stop 50 to the existing piston mechanism portion 15 and by interposing the shock-absorption means 57 therebetween, and thus, the configuration is simple and it is possible to easily find an appropriate value for spring strength or the like of the shock-absorption means 57.

REFERENCE NUMBERS

10: firing set portion
11: barrel portion
12: bullet portion
13: piston
14: cylinder
15: piston mechanism portion
16: nozzle portion
17: gas inlet
18: differential pressure valve
19: valve chamber
20: differential pressure valve mechanism
21: return spring
22: magazine portion
23: gas tank
24: gas flow path
25: on-off valve mechanism
26: on-off valve
27: outlet
28: piston return spring
29: bolt
30: movable body portion
31: buffer spring
32, 32A, 32B: trigger
33: shaft
34: trigger spring
35: disconnector
36: selector
37, 38: locking portion
39: hammer spring
40: hammer
41: shear
42: shear spring
43: engagement protrusion
44: engagement ring
45: press-beating portion
46: knocker
47: bolt protrusion
48: loading lever
50: piston stop
51: guide portion
52: guide receiving portion
53: screw
54: long hole
55: front spring bearing
56: rear spring bearing
57: shock-absorption means
58: connection piece

The invention claimed is:

1. A shock-absorption device of a piston mechanism in a simulation gun in which an air current is ejected by an operation of a piston mechanism portion to fire a bullet, wherein a piston stop which is movable relative to the piston mechanism portion is provided, wherein the piston stop is attached to one constituent member of the piston mechanism portion to absorb an impact force accompanying the operation of the piston mechanism portion, and wherein shock-absorption means is provided between the piston stop and the other constituent member of the piston mechanism portion, wherein the simulation gun is a gas gun which ejects gas to the bullet by the piston mechanism portion and moves a piston mechanism and a bolt backward by a differential pressure valve mechanism built in the piston mechanism, and wherein a mass of the piston mechanism portion which moves backward is weighed to a mass of the bolt as the impact force.

2. The shock-absorption device of a piston mechanism in simulation gun according to claim 1, wherein a piston of the piston mechanism portion is movable inside a cylinder, the cylinder includes a guide portion in a front-to-rear direction outside the cylinder, the piston stop is provided to be movable in the front-to-rear direction within a predetermined range by engagement between the piston stop and the guide portion, and a coil spring which is the shock-absorption means is provided between a spring holder provided in the cylinder and the piston stop.

3. A shock-absorption device of a piston mechanism in a simulation gun in which an air current is ejected by an operation of a piston mechanism portion to fire a bullet, wherein a piston stop which is movable relative to the piston mechanism portion is provided, wherein the piston stop is attached to one constituent member of the piston mechanism portion to absorb an impact force accompanying the operation of the piston mechanism portion, and wherein shock-absorption means is provided between the piston stop and the other constituent member of the piston mechanism portion, wherein a piston of the piston mechanism portion is movable inside a cylinder, the cylinder includes a guide portion in a front-to-rear direction outside the cylinder, the piston stop is provided to be movable in the front-to-rear direction within a predetermined range by engagement between the piston stop and the guide portion, and a coil spring which is the shock-absorption means is provided between a spring holder provided in the cylinder and the piston stop.

* * * * *